US010632522B2

(12) United States Patent
Imamura et al.

(10) Patent No.: US 10,632,522 B2
(45) Date of Patent: Apr. 28, 2020

(54) METHOD OF MANUFACTURING PRELIMINARY FORMED BODY AND AXISYMMETRICAL COMPONENT

(71) Applicant: KAWASAKI JUKOGYO KABUSHIKI KAISHA, Akashi-shi, Hyogo (JP)

(72) Inventors: Yoshihide Imamura, Kobe (JP); Yuto Sakane, Kobe (JP); Kohei Mikami, Akashi (JP); Yoshiro Kabe, Kobe (JP); Hayato Iwasaki, Kobe (JP); Hiroshi Kitano, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 689 days.

(21) Appl. No.: 15/305,848

(22) PCT Filed: Apr. 7, 2015

(86) PCT No.: PCT/JP2015/001968
§ 371 (c)(1),
(2) Date: Oct. 21, 2016

(87) PCT Pub. No.: WO2015/162864
PCT Pub. Date: Oct. 29, 2015

(65) Prior Publication Data

US 2017/0043389 A1 Feb. 16, 2017

(30) Foreign Application Priority Data

Apr. 21, 2014 (JP) ..... 2014-087020

(51) Int. Cl.
*B21D 22/14* (2006.01)
*B21H 1/06* (2006.01)
(Continued)

(52) U.S. Cl.
CPC ..... *B21H 1/06* (2013.01); *B21D 22/14* (2013.01); *B21D 37/16* (2013.01); *B21H 1/00* (2013.01); *B21H 1/04* (2013.01); *H05B 6/101* (2013.01)

(58) Field of Classification Search
CPC ..... B21D 22/14; B21D 22/16; B21D 37/16; B21D 22/18; B21D 22/185; B21H 1/02;
(Continued)

(56) References Cited

U.S. PATENT DOCUMENTS 438,406 A 10/1890 Dewey
2,767,466 A * 10/1956 Faulkner ..... H01J 9/244 228/903
(Continued)

FOREIGN PATENT DOCUMENTS

CN 202070632 U 12/2011
DE 199 16 280 A1 8/2000
(Continued)

OTHER PUBLICATIONS

Aug. 5, 2014 Search Report issued in International Patent Application No. PCT/JP2014/002454.
(Continued)

*Primary Examiner* — Edward T Tolan
(74) *Attorney, Agent, or Firm* — Oliff PLC

(57) ABSTRACT

A method of manufacturing a preliminary formed body includes an ironing step and a thickening step. In the ironing step, a predetermined range of a plate is formed into a tapered shape in such a manner that while rotating the plate, a transform target portion of the plate is locally heated by induction heating, and a processing tool is pressed against the transform target portion. In the thickening step, a peripheral portion that is a distal end of the tapered shape of the plate is expanded inward in such a manner that while
(Continued)

rotating the plate, the peripheral portion is locally heated, and a forming roller is pressed against the peripheral portion to push the peripheral portion in a direction orthogonal to a thickness direction of the peripheral portion.

12 Claims, 10 Drawing Sheets

(51) Int. Cl.
*B21D 37/16* (2006.01)
*B21H 1/04* (2006.01)
*H05B 6/10* (2006.01)
*B21H 1/00* (2006.01)

(58) Field of Classification Search
CPC ... B21H 1/04; B21H 1/06; B21H 1/00; H05B 6/101; H05B 6/102
See application file for complete search history.

(56) References Cited

U.S. PATENT DOCUMENTS

| | | | | | |
|---|---|---|---|---|---|
| 3,050,830 | A * | 8/1962 | Genter | B21D 22/18 | 29/891 |
| 3,282,078 | A * | 11/1966 | Kaesemeyer | B21D 22/16 | 72/82 |
| 3,738,139 | A * | 6/1973 | Proops | B21H 1/06 | 72/110 |
| 3,815,395 | A | 6/1974 | Sass | | |
| 3,835,282 | A * | 9/1974 | Sass | B21D 19/00 | 219/602 |
| 4,606,206 | A | 8/1986 | Daudi | | |
| 5,388,964 | A | 2/1995 | Ciokajlo et al. | | |
| 5,562,785 | A | 10/1996 | Yamanaka | | |
| 5,722,138 | A | 3/1998 | Yamanaka | | |
| 5,809,649 | A | 9/1998 | Kostermeier | | |
| 5,826,452 | A | 10/1998 | Reichhardt | | |
| 5,852,873 | A * | 12/1998 | Pollkotter | B21D 22/18 | 29/894.324 |
| 6,199,419 | B1 * | 3/2001 | Shrayer | B21D 22/16 | 72/69 |
| 6,223,576 | B1 | 5/2001 | Mashita | | |
| 6,434,991 | B1 * | 8/2002 | Jaschka | B21D 22/14 | 72/110 |
| 6,484,401 | B1 * | 11/2002 | Specht | B21D 22/16 | 29/892 |
| 7,047,781 | B1 | 5/2006 | Kanemitsu et al. | | |
| 8,959,975 | B2 | 2/2015 | Welser et al. | | |
| 2003/0200781 | A1 * | 10/2003 | Hodjat | B21D 53/261 | 72/83 |
| 2004/0134249 | A1 | 7/2004 | Utiashev et al. | | |
| 2013/0152652 | A1 * | 6/2013 | Allwood | B21D 22/16 | 72/85 |
| 2015/0089986 | A1 | 4/2015 | Nillies | | |
| 2015/0202677 | A1 | 7/2015 | Ogishi et al. | | |
| 2015/0239156 | A1 * | 8/2015 | Takada | B21D 22/16 | 264/310 |

FOREIGN PATENT DOCUMENTS

| | | | | |
|---|---|---|---|---|
| JP | 58-205623 | A * | 11/1983 | B21D 22/14 |
| JP | H06-182471 | A | 7/1994 | |
| JP | H07-166960 | A | 6/1995 | |
| JP | H07-290181 | A | 11/1995 | |
| JP | H09-66330 | A | 3/1997 | |
| JP | H10-5912 | A | 1/1998 | |
| JP | H11-739 | A | 1/1999 | |
| JP | H11-342430 | A | 12/1999 | |
| JP | 2000-197941 | A | 7/2000 | |
| JP | 2000-205273 | A | 7/2000 | |
| JP | 2001-129635 | A | 5/2001 | |
| JP | 2004-337906 | A | 12/2004 | |
| JP | 2005-028422 | A | 2/2005 | |
| JP | 2012-192414 | A | 10/2012 | |
| JP | 2012-234671 | A | 11/2012 | |
| WO | 2014/024384 | A1 | 2/2014 | |

OTHER PUBLICATIONS

May 19, 2015 Search Report issued in International Patent Application No. PCT/JP2015/001968.
Aug. 5, 2014 Written Opinion issued in International Patent Application No. PCT/JP2014/002454.
Dec. 8, 2015 International Preliminary Report issued in International Patent Application No. PCT/JP2014/002454.
Jun. 3, 2016 Office Action issued in Chinese Patent Application No. 201480025993.6.
U.S. Appl. No. 14/895,426, filed Dec. 2, 2015 in the name of Yuto Sakane.
Jan. 22, 2017 Office Action issued in Chinese Patent Application No. 201480025993.6.
Nov. 24, 2017 Extended Search Report issued in European Patent Application No. 15782316.2.
Jun. 14, 2017 Office Action issued in Taiwanese Patent Application No. 104112049.
May 3, 2017 Office Action Issued in U.S Appl. No. 14/895,426.

* cited by examiner

METHOD OF MANUFACTURING PRELIMINARY FORMED BODY AND AXISYMMETRICAL COMPONENT

TECHNICAL FIELD

The present invention relates to a method of manufacturing a preliminary formed body for an axisymmetrical component and a method of manufacturing the axisymmetrical component from the preliminary formed body.

BACKGROUND ART

Axisymmetrical components, such as an axisymmetrical component 100 that is shown in FIG. 10 and symmetrical around a central axis 101, have been used in various machines. The axisymmetrical component 100 may include a tapered portion 110 and a flange portion 120 projecting inward from a large-diameter portion of the tapered portion 110. One example of the axisymmetrical component 100 is an aircraft component. As one example of such aircraft component, FIGS. 2 and 3 of PTL 1 disclose a rear annular inner passage wall (part shown by reference sign 72) used in a gas turbine engine of an aircraft (PTL 2 will be described later).

CITATION LIST

Patent Literature

PTL 1: Japanese Laid-Open Patent Application Publication No. 7-166960

PTL 2: International Publication No. 2014/024384

SUMMARY OF INVENTION

Technical Problem

The axisymmetrical component 100 including the inward flange portion 120 shown in FIG. 10 cannot be manufactured by press forming since there exists a hollow portion covered from both sides in an axial direction of the axisymmetrical component 100. Therefore, as a method of manufacturing the axisymmetrical component 100, for example, it is thought that a block 150 having a size including the axisymmetrical component 100 is formed by forging, and the axisymmetrical component 100 is formed by cutting the block 150.

However, to form the block 150, a material whose amount is much larger than the volume of the axisymmetrical component 100 is required. Therefore, the manufacturing cost increases. To reduce the manufacturing cost, a reduction in the amount of material used is desired. Especially, as an aircraft component, a titanium alloy is used as the material in some cases from the viewpoint of weight reduction. Therefore, there is a strong demand for the reduction in the amount of expensive titanium alloy used. Thus, there is a demand for manufacturing of a preliminary formed body from which the axisymmetrical component 100 can be formed by cutting and which is similar in shape to the axisymmetrical component 100.

By using spinning forming disclosed in, for example, PTL 2, a tapered preliminary formed body can be manufactured from a plate. However, to manufacture the preliminary formed body for the axisymmetrical component 100 including the inward flange portion 120 shown in FIG. 10 by the spinning forming, a thickness of a tapered portion of the preliminary formed body needs to be larger than a thickness from the tapered portion 110 of the axisymmetrical component 100 to a tip end of the flange portion 120. It is difficult to form such thick tapered portion by the spinning forming.

An object of the present invention is to provide a method of manufacturing from a plate a preliminary formed body for an axisymmetrical component including an inward flange portion and a method of manufacturing an axisymmetrical component from the preliminary formed body manufactured by the above method.

Solution to Problem

To solve the above problems, a method of manufacturing a preliminary formed body according to the present invention is a method of manufacturing a preliminary formed body for an axisymmetrical component including a tapered portion and a flange portion projecting inward from a large-diameter portion of the tapered portion, the method including: an ironing step of forming a predetermined range of a plate into a tapered shape in such a manner that while rotating the plate, a transform target portion of the plate is locally heated, and a processing tool is pressed against the transform target portion; and a thickening step of expanding inward a peripheral portion that is a distal end of the tapered shape of the plate in such a manner that while rotating the plate, the peripheral portion is locally heated, and a forming roller is pressed against the peripheral portion to push the peripheral portion in a direction orthogonal to a thickness direction of the peripheral portion.

According to the above configuration, a portion of the preliminary formed body which portion includes the tapered portion of the axisymmetrical component can be formed by the ironing step, and a portion of the preliminary formed body which portion includes the inward flange portion of the axisymmetrical component can be formed by the thickening step. Therefore, the preliminary formed body for the axisymmetrical component including the inward flange portion can be manufactured from the plate.

The predetermined range may be from a specific position of the plate to the peripheral portion of the plate. According to this configuration, the amount of material used can be reduced to a minimum amount.

Or, the predetermined range may be from a specific position of the plate to a vicinity of the peripheral portion of the plate. In this case, the method of manufacturing the preliminary formed body may include a cutting step of cutting a portion of the plate which portion is located outside the predetermined range, the cutting step being performed between the ironing step and the thickening step. According to this configuration, since the peripheral portion of the plate remains in the ironing step, the ironing (forming of the tapered shape by pressing of the processing tool) can be easily performed.

For example, in the ironing step, the transform target portion of the plate may be heated by induction heating, and in the thickening step, the peripheral portion of the plate may be heated by the induction heating.

In the ironing step, the transform target portion may be heated by a rear-side heater disposed at an opposite side of the processing tool across the plate and a front-side heater disposed at a same side as the processing tool relative to the plate. According to this configuration, for example, even when the plate is thick, the plate can be satisfactorily processed in the ironing step.

Each of the front-side heater and the rear-side heater may include a coil portion extending in a rotational direction of the plate and having a doubled circular-arc shape facing the plate. According to this configuration, local heating of the transform target portion of the plate can be continuously performed in a rotational direction of the plate. With this, excellent formability can be obtained.

In the thickening step, the peripheral portion of the plate may be heated by the rear-side heater or the front-side heater. According to this configuration, it is unnecessary to additionally prepare a heater for the thickening step.

The forming roller may include; a cylindrical press surface extending in a rotation axis direction of the forming roller; and a ring-shaped guide surface spreading from one end portion of the press surface outward in a radial direction of the forming roller. According to this configuration, while pushing the peripheral portion of the plate by the press surface, the expansion of the peripheral portion by the pushing can be restricted to only one direction by the guide surface.

The plate may be made of a titanium alloy. Regarding steel, aluminum alloy, and the like, as the temperature increases, the yield strength (stress at which plastic deformation begins) gradually decreases. However, regarding the titanium alloy, the yield strength significantly decreases in a certain temperature range. Therefore, by heating the plate at a temperature higher than this temperature range, only a narrow area including a heated portion of the plate can be transformed in each of the ironing step and the thickening step.

For example, the axisymmetrical component may be an aircraft component.

The method of manufacturing the preliminary formed body may include a step of removing residual stress of the plate by a heat treatment, the step being performed between the ironing step and the thickening step. According to this configuration, risks such as deformation and breaks of the plate in the thickening step can be reduced.

A method of manufacturing the axisymmetrical component according to the present invention includes: removing, by a heat treatment, residual stress of the preliminary formed body obtained by the method of manufacturing the preliminary formed body; and then cutting the preliminary formed body by machine work to form the axisymmetrical component. According to this configuration, the axisymmetrical component can be manufactured at low cost.

Advantageous Effects of Invention

According to the present invention, the preliminary formed body for the axisymmetrical component including the inward flange portion can be manufactured from the plate.

BRIEF DESCRIPTION OF DRAWINGS

FIG. 6A shows a state before thickening forming. FIG. 6B shows a state after the thickening forming.

DESCRIPTION OF EMBODIMENTS

Embodiment 1

Figure 1A:
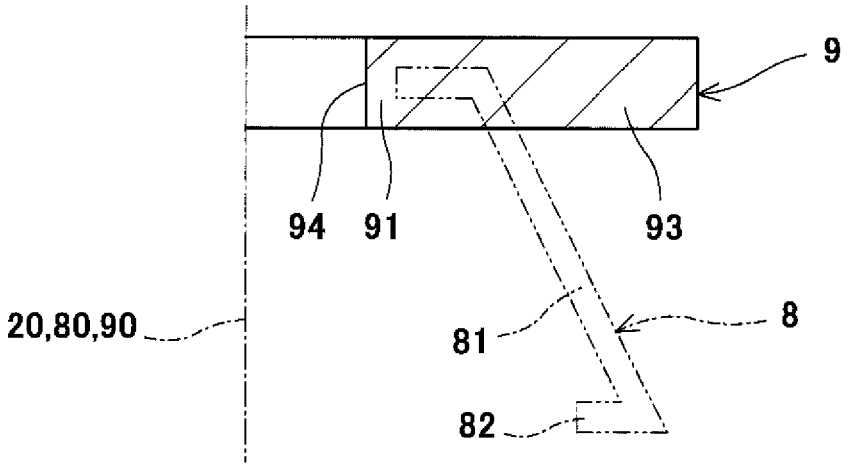
FIGS. 1A to 1C are diagrams for explaining a method of manufacturing a preliminary formed body according to Embodiment 1 of the present invention.
Figure 1B:
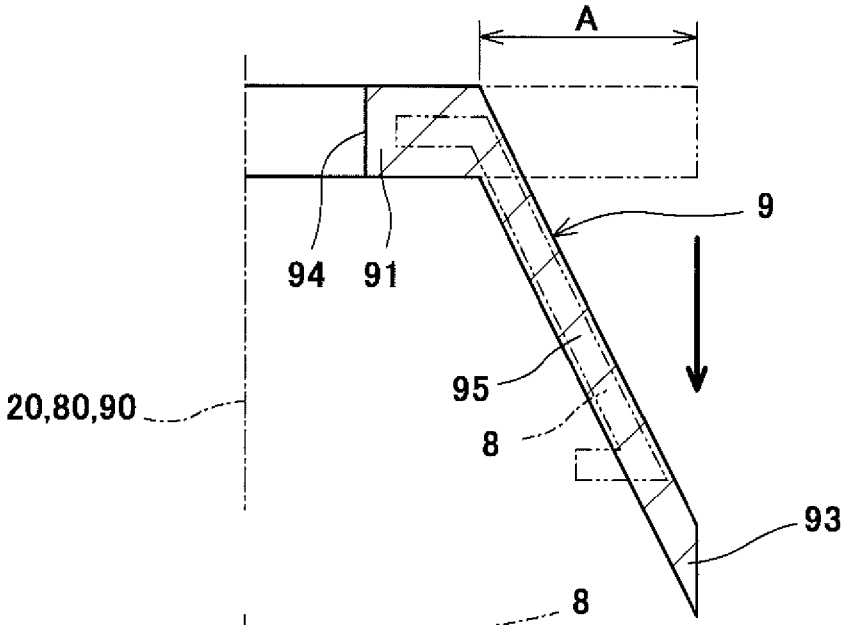
Figure 1C:
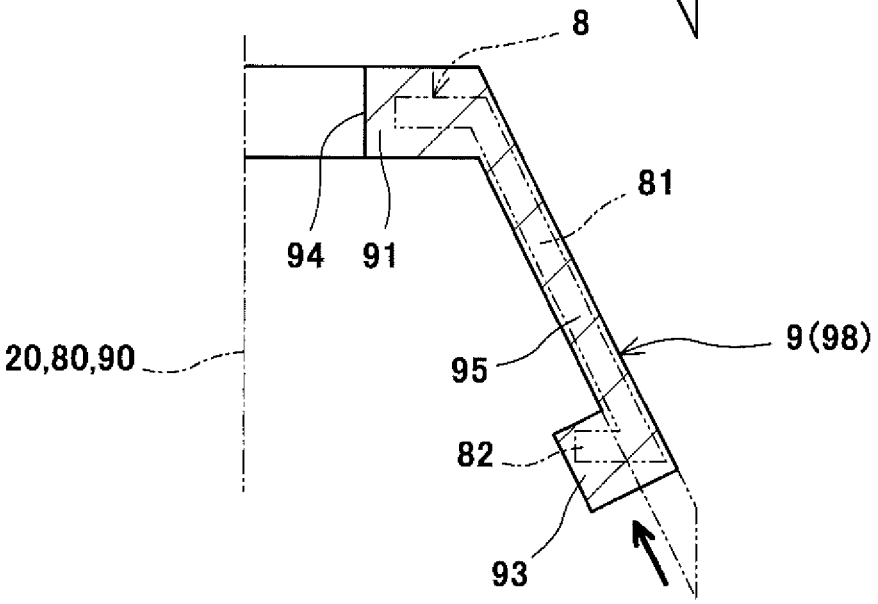

In Embodiment 1, a preliminary formed body 98 shown in FIG. 1C is manufactured from a plate 9 shown in FIG. 1A. The preliminary fruited body 98 is for an axisymmetrical component 8 and has a shape from which the axisymmetrical component 8 can be formed by cutting and which is similar to the shape of the axisymmetrical component 8.

Specifically, a method of manufacturing the preliminary formed body 98 according to Embodiment 1 includes an ironing step shown in FIG. 1B and a thickening step shown in FIG. 1C. The following will first explain the axisymmetrical component 8 and then explain the respective steps in detail.

(1) Axisymmetrical Component

The axisymmetrical component 8 has a shape symmetrical around a central axis 80. More specifically, the axisymmetrical component 8 includes a tapered portion 81 and a flange portion 82 projecting inward from a large-diameter portion of the tapered portion 81. The axisymmetrical component 8 is, for example, an aircraft component. One example of such aircraft component is, for example, a passage wall used in a gas turbine engine of an aircraft.

An angle of the tapered portion 81 is not especially limited. A cross-sectional shape of the tapered portion 81 does not necessarily have to be a linear shape and may be a curved shape or a step shape. An angle between the flange portion 82 and the tapered portion 81 is not especially limited and may be any one of an acute angle, a right angle, and an obtuse angle. A cross-sectional shape of the flange portion 82 does not necessarily have to be a linear shape and may be a curved shape or a step shape.

(2) Ironing Step

Figure 2:
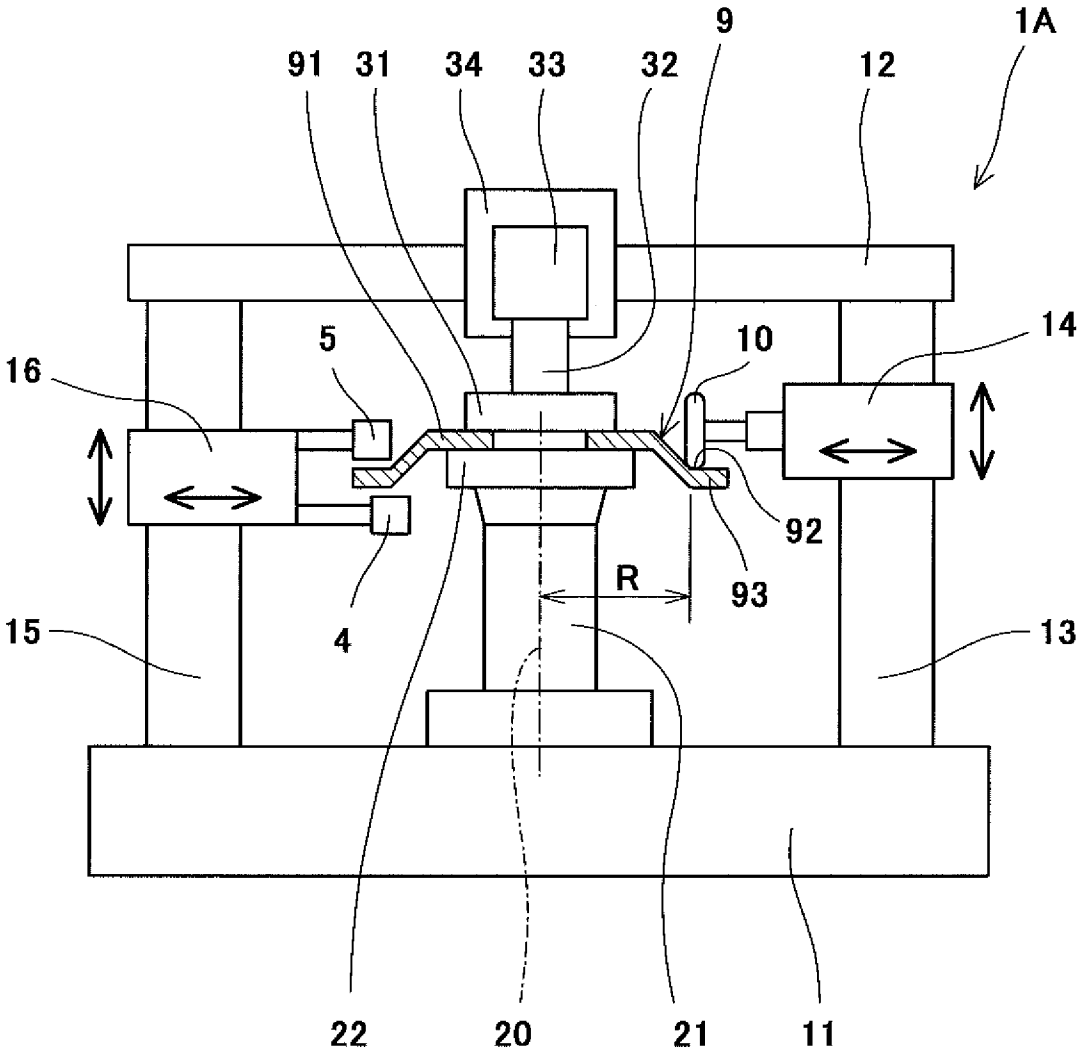
FIG. 2 is a schematic configuration diagram of a preliminary formed body manufacturing device used in an ironing step.

In the ironing step, a predetermined range A (see FIG. 1B) of the plate 9 is formed into a tapered shape 95 while rotating the plate 9 by a preliminary formed body manufacturing device 1A shown in FIG. 2. The predetermined range A is formed into the tapered shape 95 in such a manner that as shown in FIG. 2, a transform target portion 92 of the plate 9 is locally heated, and a processing tool 10 is pressed against the transform target portion 92.

In the present embodiment, the local heating of the transform target portion 92 is performed by induction heating using a rear-side heater 4 and a front-side heater 5. The rear-side heater 4 is disposed at an opposite side of the processing tool 10 across the plate 9, and the front-side heater 5 is disposed at the same side as the processing tool 10 relative to the plate 9. It should be noted that the local heating of the transform target portion 92 may be performed by any one of the rear-side heater 4 and the front-side heater 5. To be specific, the preliminary formed body manufacturing device 1A may include any one of the rear-side heater 4 and the front-side heater 5. Further, the local heating of the transform target portion 92 may be performed by, for example, a gas burner.

The preliminary formed body manufacturing device 1A includes: a rotating shaft 21 that rotates the plate 9; a receiving jig 22 attached to the rotating shaft 21 and supporting a central portion 91 of the plate 9; and a fixing jig 31 that sandwiches the plate 9 together with the receiving jig 22. The transform target portion 92 is a ring-shaped portion located away from a center axis 20 of the rotating shaft 21 by a predetermined distance R and having a predetermined width (see FIG. 3). As shown in FIGS. 1A to 1C, the center axis 20 of the rotating shaft 21 coincides with a central axis 90 of the plate 9 and the central axis 80 of the axisymmetrical component 8.

As shown in FIG. 2, an axial direction of the rotating shaft 21 (i.e., a direction in which the center axis 20 extends) is a vertical direction in the present embodiment. However, the axial direction of the rotating shaft 21 may be a horizontal direction or an oblique direction. A lower portion of the rotating shaft 21 is supported by a base 11. The rotating shaft 21 is rotated by a motor, not shown.

The plate 9 is, for example, a flat circular plate. In the present embodiment, as shown in FIG. 1A, a circular opening 94 is provided at a center of the plate 9. For example, the opening 94 is used when positioning the plate 9 with respect to the receiving jig 22. It should be noted that the plate 9 does not necessarily have to include the opening 94.

In the present embodiment, the plate 9 is made of a titanium alloy. Examples of the titanium alloy include anticorrosion alloys (such as Ti-0.15Pd), $\alpha$ alloys (such as Ti-5A1-2.5Sn), $\alpha+\beta$ alloys (such as Ti-6A1-4V), and $\beta$ alloys (Ti-15V-3Cr-3Sn-3Al). However, a material of the plate 9 is not limited to the titanium alloy and may be, for example, stainless steel, steel, or an aluminum alloy.

The receiving jig 22 has a size within a circle defined by a forming start position of the plate 9. To be specific, the plate 9 is not transformed by being pressed against a radially outer side surface of the receiving jig 22. However, when the preliminary formed body manufacturing device 1A includes only the front-side heater 5, a mandrel including a side surface as a forming surface for the plate may be used instead of the receiving jig 22.

When the plate 9 is a thick plate (for example, when a thickness of the plate 9 is not less than 20 mm), the heating of the plate 9 only from a front side or a rear side may not adequately heat the transform target portion 92 of the plate 9 to such a degree that the ironing (the forming of the tapered shape 95 by the pressing of the processing tool 10) can be performed. From this viewpoint, when the plate 9 is thick, the preliminary formed body manufacturing device 1A desirably includes both the rear-side heater 4 and the front-side heater 5. Further, to dispose the rear-side heater 4, the preliminary formed body manufacturing device 1A desirably includes the receiving jig 22 instead of the mandrel. With this, the thick plate 9 can be satisfactorily processed.

The fixing jig 31 is attached to a pressurizing rod 32. The pressurizing rod 32 is rotatably supported by a supporting portion 33. The supporting portion 33 is driven by a driving portion 34 in an upward/downward direction. The driving portion 34 is attached to a frame 12 disposed above the rotating shaft 21. It should be noted that the fixing jig 31 may be omitted, and the plate 9 may be directly fixed to the receiving jig 22 by, for example, bolts.

The processing tool 10 that presses the transform target portion 92 of the plate 9 is disposed above the plate 9, and the plate 9 is formed in a downwardly opening shape that accommodates the receiving jig 22. However, the processing tool 10 may be disposed under the plate 9, and the plate 9 may be formed in an upwardly opening shape that accommodates the fixing jig 31.

The processing tool 10 is moved by a radial direction movement mechanism 14 in a radial direction of the rotating shaft 21 and is also moved by an axial direction movement mechanism 13 through the radial direction movement mechanism 14 in the axial direction of the rotating shaft 21. The axial direction movement mechanism 13 extends so as to couple the base 11 and the frame 12. In the present embodiment, used as the processing tool 10 is a roller that follows the rotation of the plate 9 to rotate. However, the processing tool 10 is not limited to the roller and may be, for example, a spatula. Further, a plurality of processing tools 10 may be used.

In the present embodiment, the processing tool 10 is moved by the radial direction movement mechanism 14 from a specific position of the plate 9 to a peripheral portion 93 of the plate 9 while being pressed downward by the axial direction movement mechanism 13 against the plate 9. To be specific, the predetermined range A formed into the tapered shape 95 is from the specific position of the plate 9 to the peripheral portion 93.

The "specific position" that is an inside end of the predetermined range A is desirably a position located away from a peripheral portion of the receiving jig 22 outward in the radial direction such that the rear-side heater 4 can be disposed at a position immediately under the specific position. However, if the heating at the specific position can be adequately performed even when the rear-side heater 4 is disposed at a position displaced outward in the radial direction from the position immediately under the specific position, the specific position may coincide with the peripheral portion of the receiving jig 22. When a mandrel is used, the specific position coincides with a corner portion between a forming surface that is a side surface of the mandrel and a supporting surface that receives the plate 9.

The rear-side heater 4 and the front-side heater 5 are moved by a radial direction movement mechanism 16 in the radial direction of the rotating shaft 21 and are also moved by an axial direction movement mechanism 15 through the radial direction movement mechanism 16 in the axial direction of the rotating shaft 21. The axial direction movement mechanism 15 extends so as to couple the base 11 and the frame 12.

For example, a displacement meter (not shown) is attached to at least one of the rear-side heater 4 and the front-side heater 5. The displacement meter measures a distance to the transform target portion 92 of the plate 9. The rear-side heater 4 and the front-side heater 5 are moved in the axial direction and radial direction of the rotating shaft 21 such that a measured value of the displacement meter becomes constant.

The positional relationship between the rear-side and front-side heaters 4 and 5 and the processing tool 10 is not especially limited as long as they are located on substantially the same circumference around the center axis 20 of the rotating shaft 21. For example, the rear-side and front-side heaters 4 and 5 may be separated from the processing tool 10 in a circumferential direction of the rotating shaft 21 by 180°.

Figure 3:
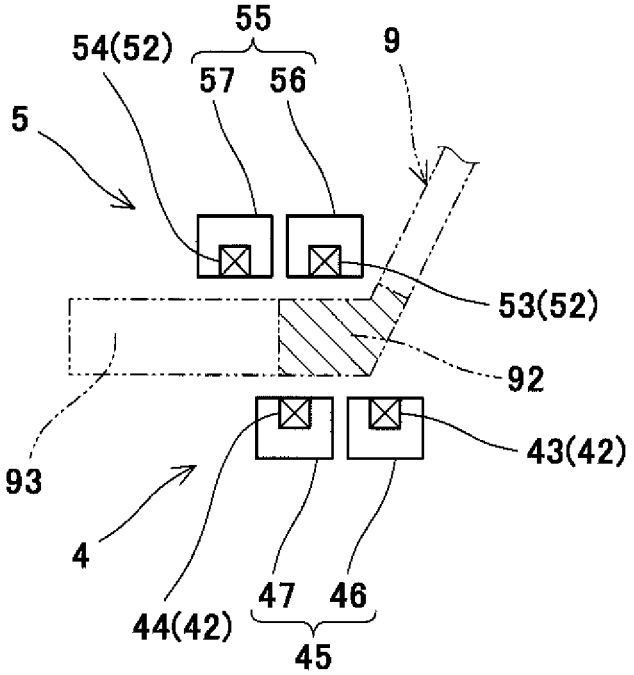
FIG. 3 is a cross-sectional view of a rear-side heater and a front-side heater.
Figure 4B:
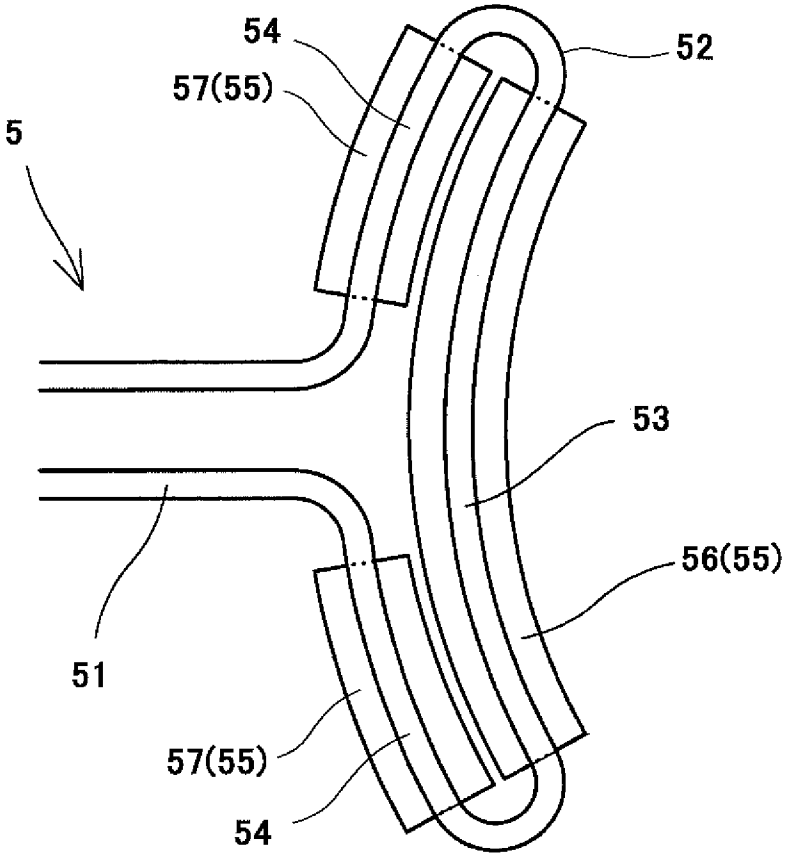
FIG. 4B is a bottom view of the front-side heater.
Figure 4A:
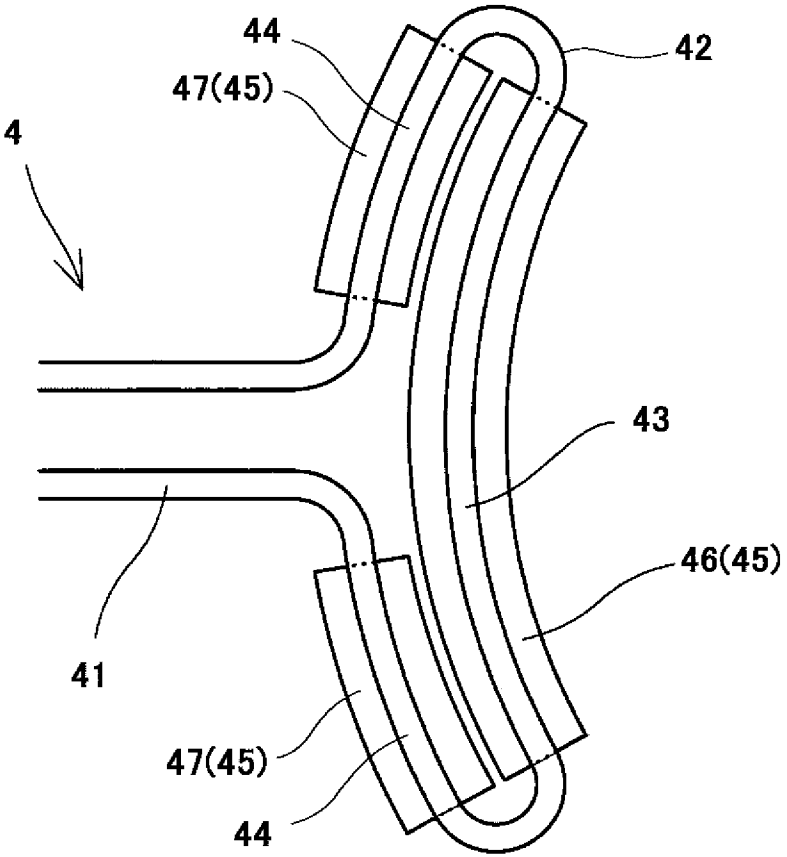
FIG. 4A is a plan view of the rear-side heater.

As shown in FIGS. 3 and 4A, the rear-side heater 4 includes: an electric conducting pipe 41 including a coil portion 42; and a core 45 that collects magnetic flux generated around the coil portion 42. A cooling liquid flows in the electric conducting pipe 41. The coil portion 42 has a doubled circular-arc shape extending in a rotational direction of the plate 9 and facing the plate 9. An opening angle (angle between both end portions) of the coil portion 42 is, for example, 60° to 120°. The core 45 is constituted by one inner peripheral piece 46 and two outer peripheral pieces 47. The inner peripheral piece 46 covers an inner circular-arc portion 43 of the coil portion 42 from an opposite side of the plate 9. The outer peripheral pieces 47 cover outer circular-arc portions 44 of the coil portion 42 from the opposite side of the plate 9.

Similarly, as shown in FIGS. 3 and 411, the front-side heater 5 includes: an electric conducting pipe 51 including a coil portion 52; and a core 55 that collects magnetic flux generated around the coil portion 52. The cooling liquid flows in the electric conducting pipe 51. The coil portion 52 has a doubled circular-arc shape extending in the rotational direction of the plate 9 and facing the plate 9. An opening angle (angle between both end portions) of the coil portion 52 is, for example, 60° to 120°. The core 55 is constituted by one inner peripheral piece 56 and two outer peripheral pieces 57. The inner peripheral piece 56 covers an inner circular-arc portion 53 of the coil portion 52 from the opposite side of the plate 9. The outer peripheral pieces 57 cover outer circular-arc portions 54 of the coil portion 52 from the opposite side of the plate 9.

As described above, each of the rear-side heater 4 and the front-side heater 5 includes the coil portion (42 or 52) extending in the rotational direction of the plate 9. Therefore, the local heating of the transform target portion 92 of the plate 9 can be continuously performed in the rotational direction of the plate 9. Thus, excellent formability can be obtained.

An alternating voltage is applied to the electric conducting pipe 41 of the rear-side heater 4 and the electric conducting pipe 51 of the front-side heater 5. A frequency of the alternating voltage is not especially limited but is desirably a high frequency of 5 k to 400 kHz. To be specific, the induction heating performed by the rear-side heater 4 and the front-side heater 5 is desirably high frequency induction heating.

(3) Thickening Step

Figure 5:
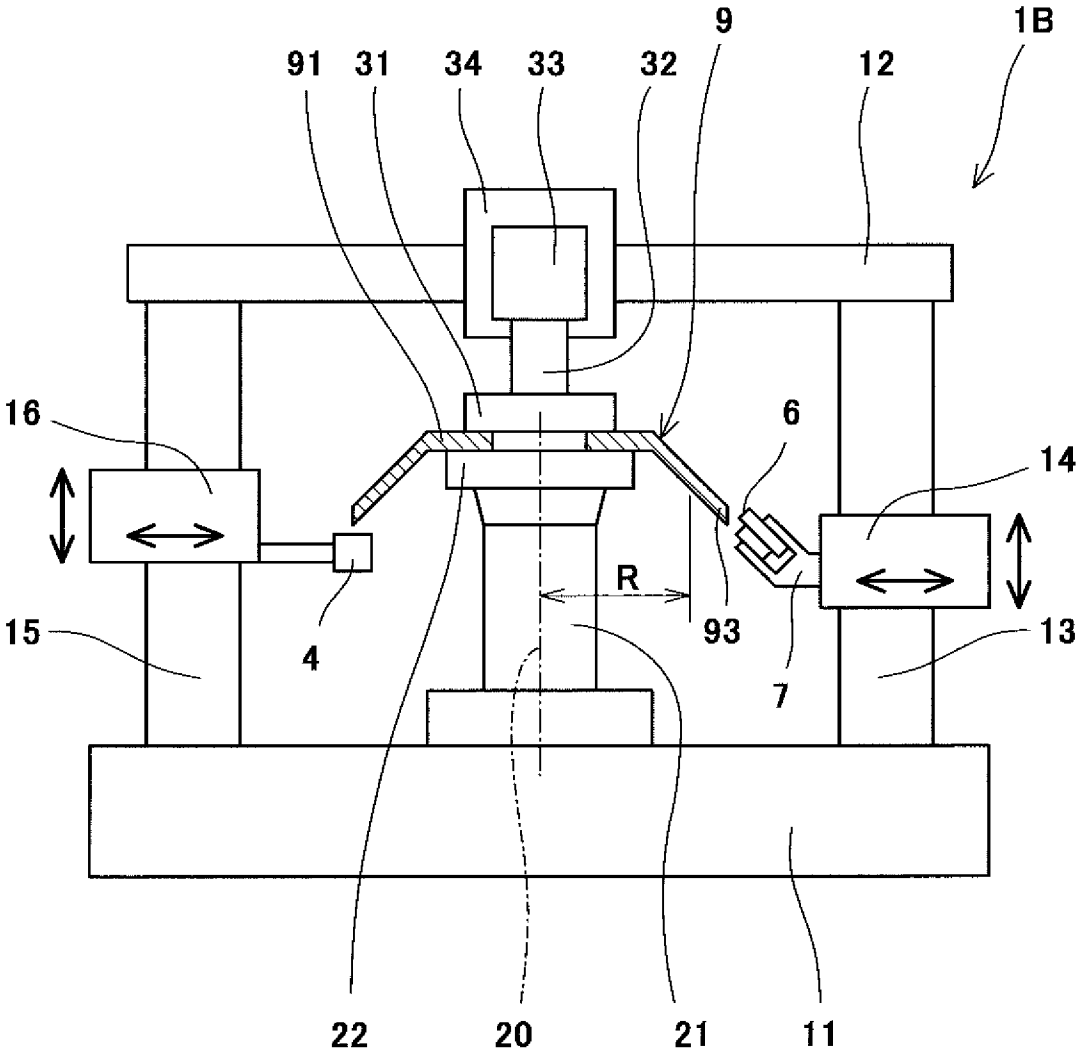
FIG. 5 is a schematic configuration diagram of a preliminary formed body manufacturing device used in a thickening step.

In the thickening step, the peripheral portion 93 that is a distal end of the tapered shape 95 of the plate 9 is expanded inward while rotating the plate 9 by a preliminary formed body manufacturing device 111 shown in FIG. 5 (see FIG. 1C). As shown in FIG. 5, the peripheral portion 93 is expanded inward in such a manner that: the peripheral portion 93 of the plate 9 is locally heated; and a forming roller 6 is pressed against the peripheral portion 93 so as to push the peripheral portion 93 in a direction orthogonal to a thickness direction of the peripheral portion 93. A plurality of forming rollers 6 may be used.

The preliminary formed body manufacturing device 1B shown in FIG. 5 is configured such that in the preliminary formed body manufacturing device 1A shown in FIG. 2, the processing tool 10 is replaced with the forming roller 6, and the front-side heater 5 is detached. To be specific, the local heating of the peripheral portion 93 is performed by the induction heating using the rear-side heater 4. Therefore, it is unnecessary to additionally prepare a heater for the thickening step. For example, a temperature of the peripheral portion 93 of the plate 9 is measured, and the alternating voltage applied to the electric conducting pipe 41 of the rear-side heater 4 is controlled such that the measured temperature becomes a target temperature. It should be noted that the local heating of the peripheral portion 93 may be performed by the induction heating using the front-side heater 5. Or, the local heating of the peripheral portion 93 may be performed by, for example, a gas burner.

Figure 6B:
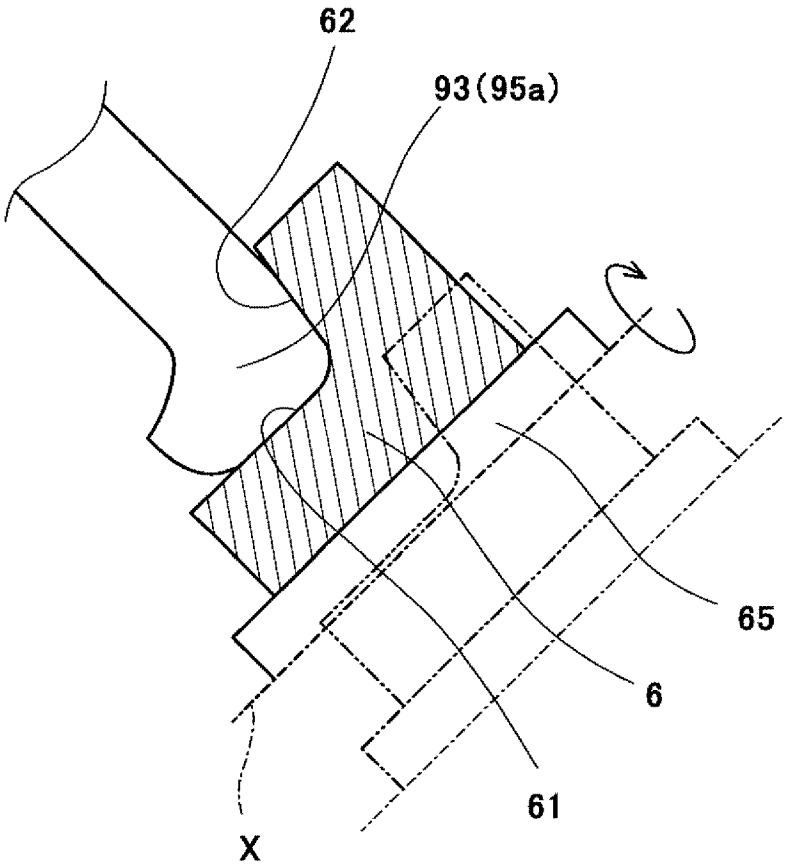
FIGS. 6A and 6B are partial cross-sectional views of a forming roller.
Figure 6A:
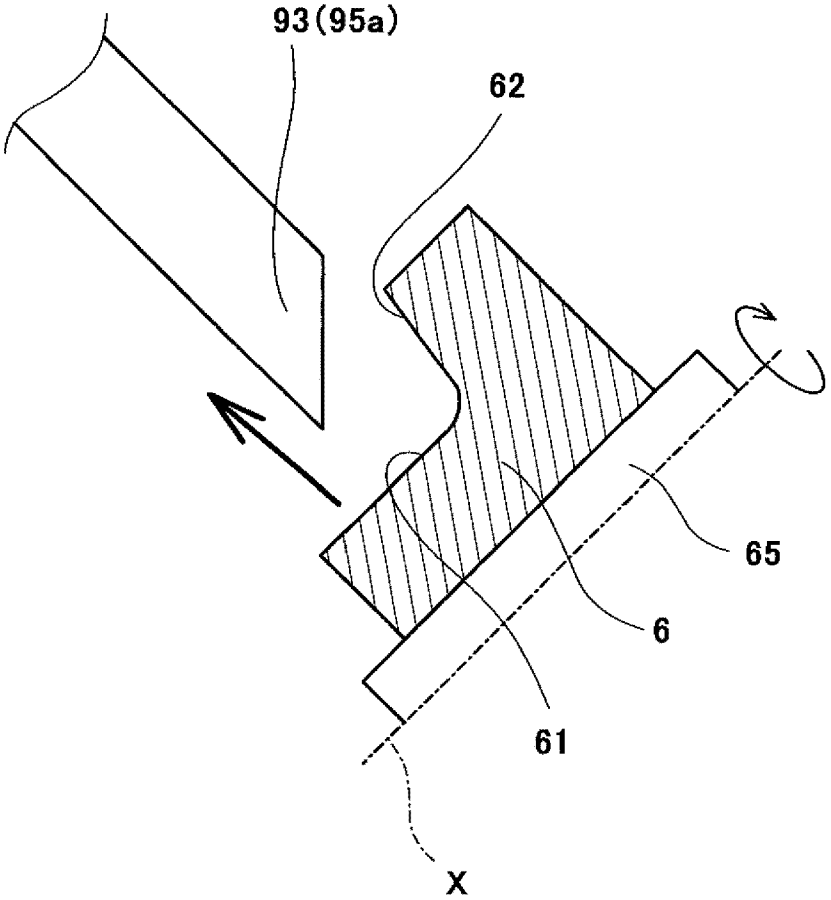

The forming roller 6 is attached to the radial direction movement mechanism 14 through a bracket 7. Specifically, as shown in FIG. 6A, the forming roller 6 includes a through hole at a center thereof, and a shaft 65 is inserted into the through hole. Each of a pair of bearings rotatably supporting the forming roller 6 is disposed between the shaft 65 and the through hole. For simplification of FIG. 6A, the forming roller 6 is shown so as to be fitted in the shaft 65, and the bearings are omitted. Both end portions of the shaft 65 are supported by the bracket 7.

More specifically, the forming roller 6 includes a cylindrical press surface 61 and a guide surface 62. The press surface 61 extends in a rotation axis direction X of the forming roller 6. The guide surface 62 spreads outward in the radial direction from one end portion of the press surface 61. In the present embodiment, the guide surface 62 forms an obtuse angle together with the press surface 61. However, the guide surface 62 may be vertical to the press surface 61 or may form an acute angle together with the press surface 61.

For example, the forming roller 6 is pressed against the peripheral portion 93 in a state where the rotation axis direction X is made parallel to the thickness direction of the peripheral portion 93 of the plate 9 such that the guide surface 62 faces an obliquely lower side. At this time, the forming roller 6 is moved by the radial direction movement mechanism 14 and the axial direction movement mechanism 13 in, for example, a direction slightly close to a horizontal direction relative to a direction orthogonal to the thickness direction of the peripheral portion 93. With this, as shown in FIG. 6B, the peripheral portion 93 can be expanded inward. To be specific, while pushing the peripheral portion 93 of the plate 9 by the press surface 61 of the forming roller 6, the expanding of the peripheral portion 93 by the pushing can be restricted to only one direction by the guide surface 62.

The preliminary formed body 98 shown in FIG. 1C is obtained by the ironing step and the thickening step explained above. To manufacture the axisymmetrical component 8 from the preliminary formed body 98, residual stress of the preliminary formed body 98 is removed by a heat treatment, and the axisymmetrical component 8 is then formed by cutting the preliminary formed body 98 by machine work. With this, the axisymmetrical component 8 can be manufactured at low cost.

It should be noted that a step of removing the residual stress from the plate 9 by the heat treatment may be performed between the ironing step and the thickening step. According to this configuration, risks such as deformation and breaks of the plate 9 in the thickening step can be reduced.

As explained above, according to the method of manufacturing the preliminary formed body of the present embodiment, a portion of the preliminary formed body 98 which portion includes the tapered portion 81 of the axisymmetrical component 8 can be formed by the ironing step, and a portion of the preliminary formed body 98 which portion includes the inward flange portion 82 of the axisymmetrical component 8 can be formed by the thickening step. Therefore, the preliminary formed body 98 for the axisymmetrical component 8 including the inward flange portion 82 can be manufactured from the plate 9.

Figure 7:
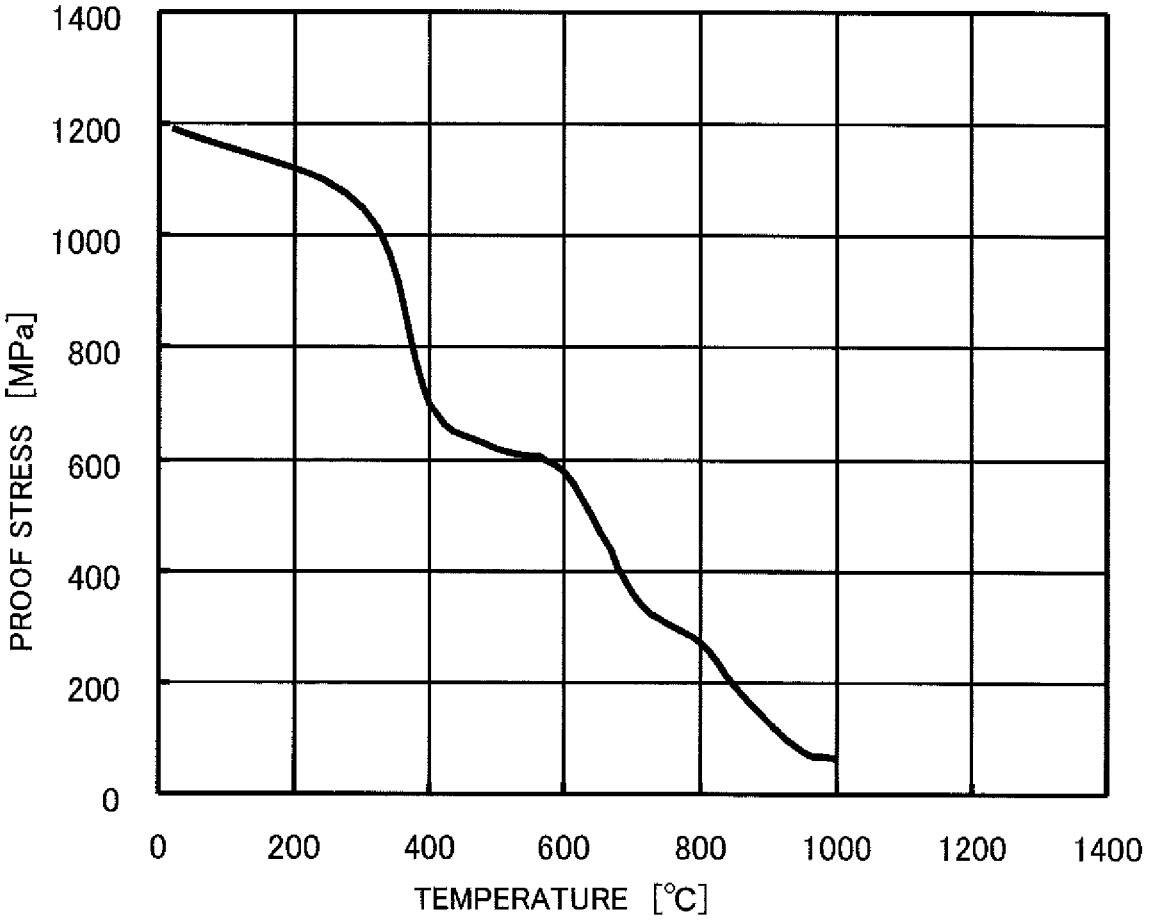
FIG. 7 is a graph showing a relation between a temperature and yield strength of Ti-6A1-4V that is a titanium alloy.

Regarding steel, an aluminum alloy, and the like, as the temperature increases, the yield strength (stress at which plastic deformation begins) gradually decreases. However, regarding the titanium alloy, as shown in FIG. 7, for example, the yield strength significantly decreases in a certain temperature range (about 320° C. to 400° C.). Therefore, by heating the plate 9 at a temperature higher than this temperature range, only a narrow area including a heated portion of the plate 9 can be transformed in each of the ironing step and the thickening step.

Modified Example

In the ironing step, an auxiliary tool that supports a portion of the plate 9 which portion is located outside the transform target portion 92 may be used. The auxiliary tool may be disposed at the rear side of the plate 9 so as to prevent downward deformation of the portion of the plate 9 which portion is located outside the transform target portion 92 or may be disposed at the front side of the plate 9 so as to prevent upward deformation of the portion of the plate 9 which portion is located outside the transform target portion 92. Or, the auxiliary tools may be disposed at both the rear side and front side of the plate 9 so as to sandwich the portion of the plate 9 which portion is located outside the transform target portion 92. One example of the auxiliary tool is a roller.

In the thickening step, the auxiliary roller may be auxiliarily pressed against the peripheral portion 93 from the front side of the plate 9 so as to prevent the peripheral portion 93 of the plate 9 from being expanded outward by the pressing of the forming roller 6. For example, a rotation axis direction of the auxiliary roller may be orthogonal to the thickness direction of the peripheral portion 93 such that an outer peripheral surface of the auxiliary roller contacts the peripheral portion 93 or may be parallel to the thickness direction of the peripheral portion 93 such that one of both end surfaces of the auxiliary roller contacts the peripheral portion 93.

Embodiment 2

Figure 8A:
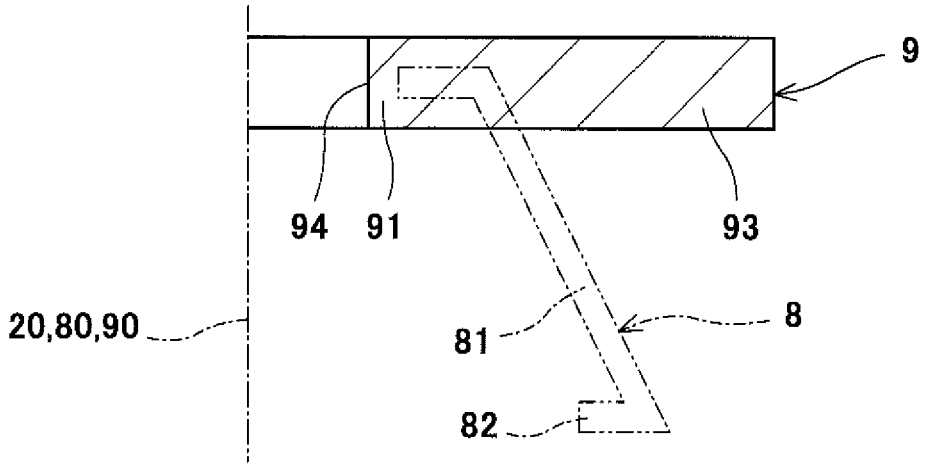
FIGS. 8A to 8C are diagrams for explaining a method of manufacturing the preliminary formed body according to Embodiment 2 of the present invention.
Figure 8B:
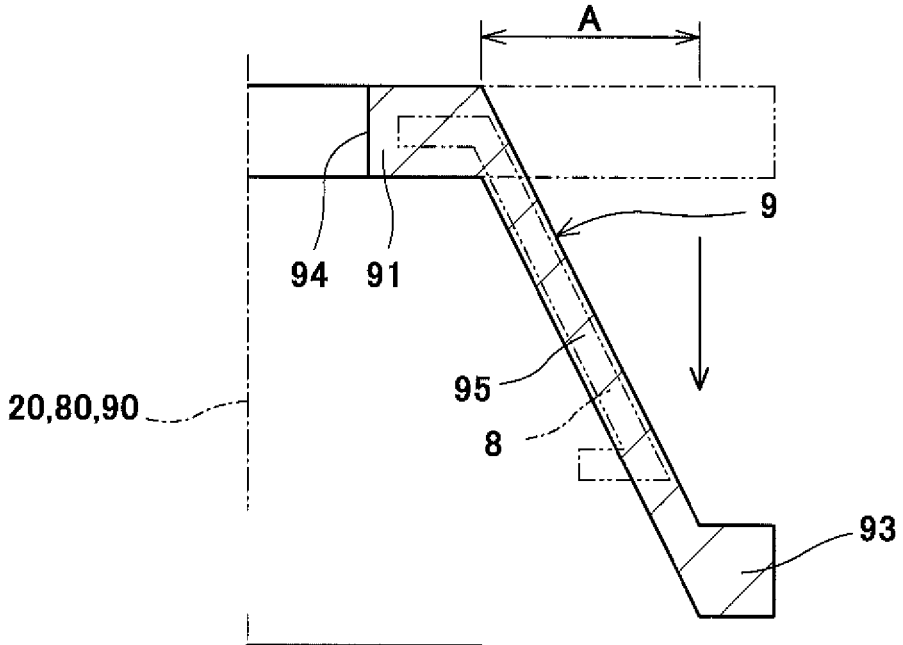

In Embodiment 2, the preliminary formed body 98 shown in FIG. 1C is manufactured from the plate 9 shown in FIG. 8A. Specifically, a method of manufacturing the preliminary formed body 98 according to Embodiment 2 includes a cutting step shown in FIG. 8C between the ironing step shown in FIG. 8B and the thickening step shown in FIG. 1C.

In the present embodiment, since the cutting step is performed, the shape of the plate 9 is not limited to a circular shape. For example, the shape of the plate 9 may be a polygonal shape such as a triangular shape or a trapezoidal shape or may be an elongated shape such as a rectangular shape or an oval shape.

The ironing step of the present embodiment is different from the ironing step of Embodiment 1 regarding the predetermined range A formed into the tapered shape 95 in the plate 9. Specifically, in the present embodiment, as shown in FIG. 2, the processing tool 10 is moved by the radial direction movement mechanism 14 from the specific position of the plate 9 to the vicinity of the peripheral portion 93 while being pressed downward by the axial direction movement mechanism 13 against the plate 9. To be specific, the predetermined range A formed into the tapered shape 95 is from the specific position of the plate 9 to the vicinity of the peripheral portion 93. Here, "the vicinity of the peripheral portion 93" is, for example, a position located at an inner side of an end surface of the plate 9 by 1/20 to 1/4 of a radius of the plate 9.

Figure 8C:
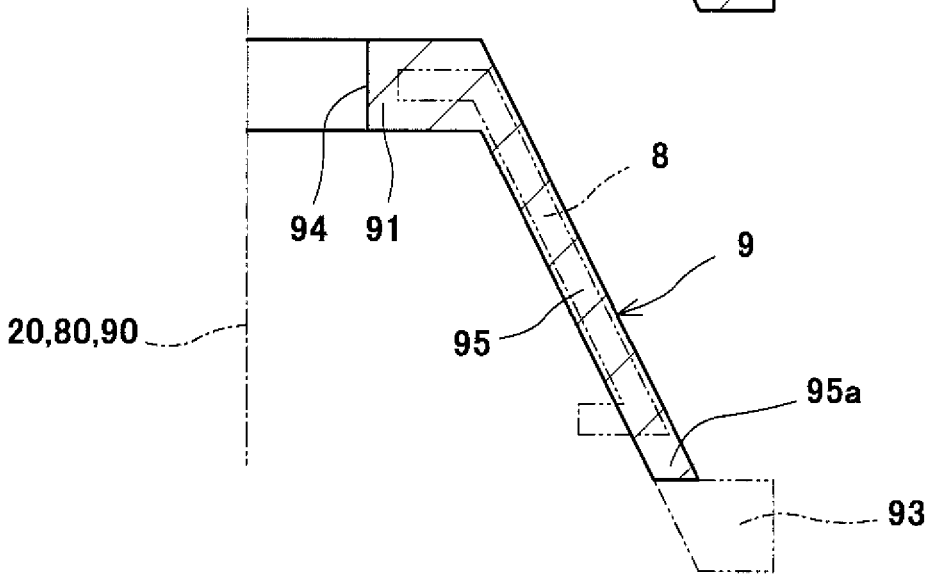

In the cutting step, the portion of the plate 9 which portion is located outside the predetermined range A is cut. A direction of this cutting may be a horizontal direction as shown in FIG. 8C or a vertical direction. Or, the direction of this cutting may be an oblique direction (such as a thickness direction of the tapered shape 95). By the cutting step, a distal end 95*a* of the tapered shape 95 becomes the peripheral portion of the plate 9. It should be noted that after the portion of the plate 9 which portion is located outside the predetermined range A is cut, the peripheral portion of the plate 9 may be subjected to chamfering or corner rounding processing.

The thickening step of the present embodiment is the same as the thickening step of Embodiment 1, and the reference sign of the peripheral portion of the plate 9 in FIGS. 5, 6A, and 6B is just changed from 93 to 95*a*.

The present embodiment can obtain the same effects as Embodiment 1. Further, according to the method of manufacturing the preliminary formed body 98 of the present embodiment, the peripheral portion 93 of the plate 9 remains in the ironing step, so that the ironing can be easily performed. It should be noted that when the predetermined range A is from the specific position of the plate 9 to the peripheral portion 93 as in Embodiment 1, the diameter of the plate 9 can be reduced. As a result, the amount of material used can be reduced to a minimum amount.

Other Embodiments

The present invention is not limited to the above embodiments, and various modifications may be made within the scope of the present invention.

Figure 9A:
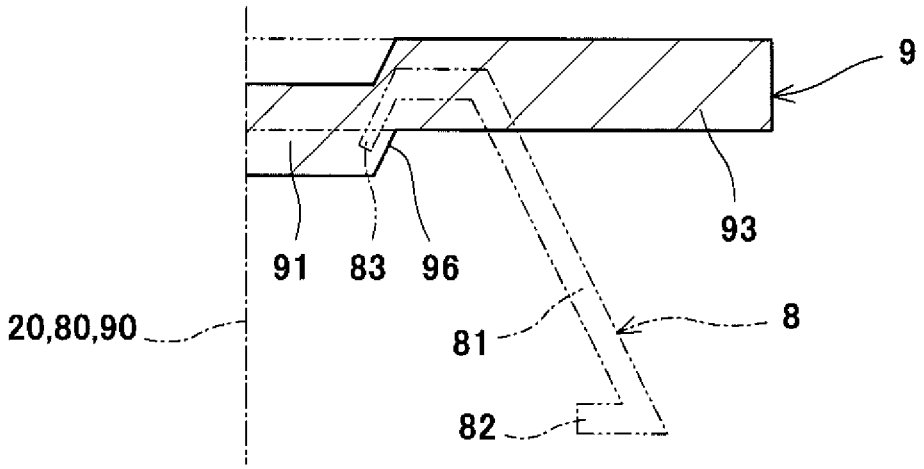
FIGS. 9A and 9B are diagrams for explaining the method of manufacturing the preliminary formed body according to another embodiment.
Figure 9B:
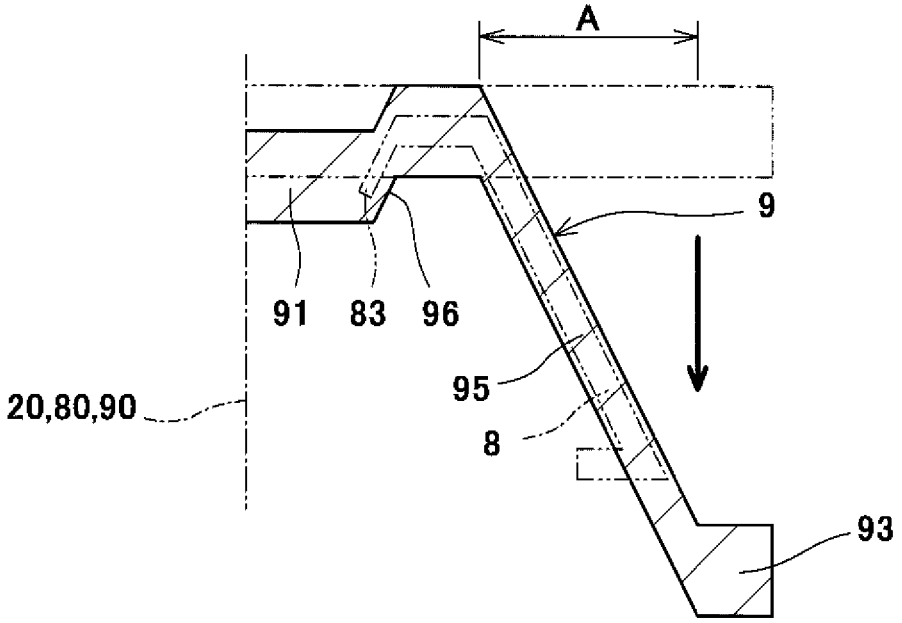
Figure 10:
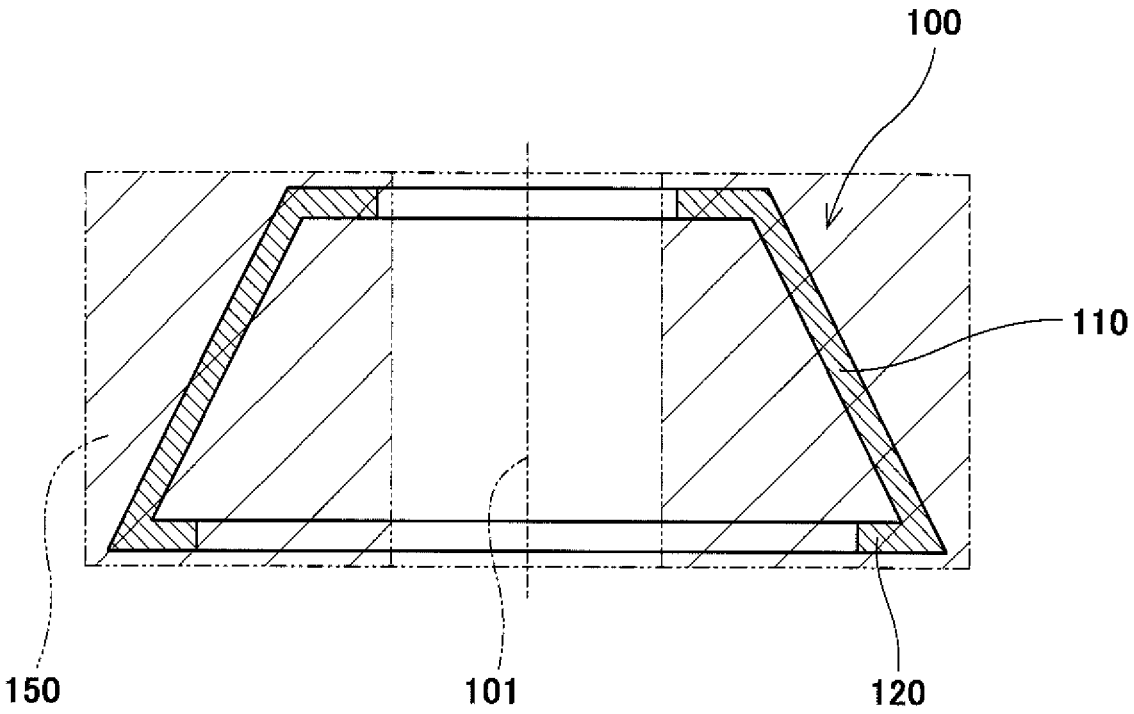
FIG. 10 is a cross-sectional view of an axisymmetrical component including an inward flange portion.

For example, as shown in FIG. 9A, when the axisymmetrical component 8 includes an annular projection 83 located at a small-diameter portion of the tapered portion 81 and facing the tapered portion 81, the preliminary formed body 98 may be manufactured in the following manner. First, in a state where the plate 9 is turned upside down such that a rear surface thereof faces upward, the ironing is performed while pressing the processing tool 10 against the rear surface of the plate 9. Thus, a step 96 is formed at a position corresponding to the annular projection 83. Then, the plate 9 is returned to a proper state (state shown in FIG. 9A) in which the rear surface faces downward, and the ironing is performed while pressing the processing tool 10 against a front surface of the plate 9 as shown in FIG. 9B.

In the thickening step, the forming roller 6 is pressed against the peripheral portion (93 or 95*a*) that is the distal end of the tapered shape while swinging the forming roller 6 on a vertical surface spreading through the center axis 20 of the rotating shaft 21. With this, the peripheral portion can be expanded in not only the thickness direction of the peripheral portion as shown in FIG. 1C but also any direction.

Each of the rear-side heater 4 and the front-side heater 5 does not necessarily have to include the coil portion (42 or 52) having the doubled circular-arc shape. For example, one or each of the rear-side heater 4 and the front-side heater 5 may include a plurality of circular coil portions arranged in a circular-arc shape or may include only one circular coil portion.

INDUSTRIAL APPLICABILITY

The present invention is useful when manufacturing a preliminary formed body for an axisymmetrical component used in various machines and is extremely useful especially when the axisymmetrical component is an aircraft component.

REFERENCE SIGNS LIST

10 processing tool
4 rear-side heater
42 coil portion

5 front-side heater
52 coil portion
6 forming roller
61 press surface
62 guide surface
8 axisymmetrical component
81 tapered portion
82 flange portion
9 plate
92 transform target portion
93 peripheral portion
95 tapered shape
95*a* peripheral portion

The invention claimed is:

1. A method of manufacturing a preliminary formed body for an axisymmetrical component including a tapered portion and a flange portion, the tapered portion being tubular and increasing in diameter from a first side to a second side opposite the first side in an axial direction, the flange portion projecting inward from a large-diameter portion of the tapered portion, the method comprising:

an ironing step of forming a predetermined range of a plate into a tapered shape in such a manner that while rotating the plate, a transform target portion of the plate is locally heated, and a processing tool is pressed against the transform target portion; and a thickening step of expanding inward a peripheral portion that is a distal end of the tapered shape of the plate in such a manner that while rotating the plate, the peripheral portion is locally heated, and while making a forming roller move obliquely toward a rotation axis of the plate, the forming roller is pressed against the peripheral portion to push the peripheral portion in a direction orthogonal to a thickness direction of the peripheral portion.

2. The method according to claim 1, wherein the predetermined range is from a specific position of the plate to the peripheral portion of the plate.

3. The method according to claim 1, wherein the predetermined range is from a specific position of the plate to a vicinity of the peripheral portion of the plate, the method further comprising a cutting step of cutting a portion of the plate which portion is located outside the predetermined range, the cutting step being performed between the ironing step and the thickening step.

4. The method according to claim 1, wherein:

in the ironing step, the transform target portion of the plate is heated by induction heating; and in the thickening step, the peripheral portion of the plate is heated by the induction heating.

5. The method according to claim 1, wherein in the ironing step, the transform target portion is heated by a rear-side heater disposed at an opposite side of the processing tool across the plate and a front-side heater disposed at a same side as the processing tool relative to the plate.

6. The method according to claim 5, wherein each of the front-side heater and the rear-side heater includes a coil portion extending in a rotational direction of the plate and having a doubled circular-arc shape facing the plate.

7. The method according to claim 5, wherein in the thickening step, the peripheral portion of the plate is heated by the rear-side heater or the front-side heater.

8. The method according to claim 1, wherein the forming roller includes: a cylindrical press surface extending in a rotation axis direction of the forming roller; and a ring-shaped guide surface spreading from one end portion of the press surface outward in a radial direction of the forming roller.

9. The method according to claim 1, wherein the plate is made of a titanium alloy.

10. The method according to claim 1, wherein the axisymmetrical component is an aircraft component.

11. The method according to claim 1, further comprising a step of removing residual stress of the plate by a heat treatment, the step being performed between the ironing step and the thickening step.

12. A method of manufacturing an axisymmetrical component, the method comprising:

removing, by a heat treatment, residual stress of the preliminary formed body obtained by the method according to claim 1; and then cutting the preliminary formed body by machine work to form the axisymmetrical component.

* * * * *